US005701940A

United States Patent [19]

Ford et al.

[11] Patent Number: 5,701,940

[45] Date of Patent: *Dec. 30, 1997

[54] CELLULAR SHADE

[75] Inventors: James Arthur Ford; Don Lee Bertva, both of Sturgis, Mich.; James Murrell Kennedy, Elkhart, Ind.; Ronald Lynn Presdorf, Sturgis, Mich.

[73] Assignee: Cooper Industries, Inc., Houston, Tex.

[ * ] Notice: The term of this patent shall not extend beyond the expiration date of Pat. No. Des. 352,856.

[21] Appl. No.: 509,910

[22] Filed: Aug. 1, 1995

Related U.S. Application Data

[63] Continuation-in-part of Ser. No. 208,981, Mar. 10, 1994, abandoned.

[51] Int. Cl.[6] ..... E06B 3/48

[52] U.S. Cl. ..... 160/84.05; 156/197; 428/118

[58] Field of Search ..... 160/84.01–84.11; 156/193, 197; 428/116, 118

[56] References Cited

U.S. PATENT DOCUMENTS

| | | | |
|---|---|---|---|
| Re. 30,254 | 4/1980 | Rasmussen | 160/84 |
| D. 352,856 | 11/1994 | Ford | D6/575 |
| 2,201,356 | 5/1940 | Terrell . | |
| 3,296,059 | 1/1967 | Schwindt | 161/69 |
| 3,646,877 | 3/1972 | Ellis | 98/110 |
| 3,952,733 | 4/1976 | Scholer | 160/84 |
| 3,999,590 | 12/1976 | Koch | 160/84 |
| 4,019,554 | 4/1977 | Rasmussen | 160/84 |
| 4,288,485 | 9/1981 | Suominen | 428/116 |
| 4,307,768 | 12/1981 | Anderson | 160/84 |
| 4,347,887 | 9/1982 | Brown | 160/368 |
| 4,422,492 | 12/1983 | Bledsoe | 160/84 |
| 4,450,027 | 5/1984 | Colson | 156/193 |
| 4,535,828 | 8/1985 | Brockhaus | 160/84 |
| 4,544,011 | 10/1985 | Sawamura | 160/84 |
| 4,603,072 | 7/1986 | Colson | 428/116 |
| 4,603,725 | 8/1986 | Knight | 160/243 |
| 4,625,786 | 12/1986 | Carter et al. | 160/84 |
| 4,631,108 | 12/1986 | Colson | 156/461 |
| 4,631,217 | 12/1986 | Anderson | 428/118 |
| 4,647,488 | 3/1987 | Schnebly et al. | 428/116 |
| 4,673,600 | 6/1987 | Anderson | 428/12 |
| 4,675,060 | 6/1987 | Schnebly et al. | 156/65 |
| 4,676,855 | 6/1987 | Anderson | 156/193 |
| 4,677,012 | 6/1987 | Anderson | 428/116 |
| 4,677,013 | 6/1987 | Anderson | 428/116 |
| 4,685,986 | 8/1987 | Anderson | 156/197 |
| 4,687,039 | 8/1987 | Chumbley | 160/84 |
| 4,694,144 | 9/1987 | Delarouche et al. | 160/84.01 X |
| 4,732,630 | 3/1988 | Schnebly | 156/64 |

(List continued on next page.)

FOREIGN PATENT DOCUMENTS

| | | | |
|---|---|---|---|
| 129793 | 11/1948 | Australia . | |
| 756270 | 9/1956 | United Kingdom . | |
| 2 236 551 | 4/1991 | United Kingdom | E06B 9/262 |
| 2 247 698 | 3/1992 | United Kingdom | D06J 1/06 |

OTHER PUBLICATIONS

A/S Chr. Fabers Fabriker, *Katalog Nr. 27* (undated).

A/S Chr. Fabers Fabriker, brochure ("Faber's Varme–Isolerende Papir–Persienne") (undated).

Declaration of Mr. Aage Mortensen, Feb. 18, 1997.

Declaration of Mr. I. Sogaard Andersen, Jan. 17, 1997.

A/S Chr. Fabers Fabriker, *Faber's Thermally Insulating Venetian Blinds*; 1941 catalog (No. 25).

A/S Chr. Fabers Fabriker, *Faber's Thermally Insulating Venetian Blinds*; 1943 catalog (No. 26).

*Primary Examiner*—Blair Johnson

*Attorney, Agent, or Firm*—Kenyon & Kenyon

[57] ABSTRACT

A cellular pleated shade material is provided for cellular pleated shades. Each pleat thereof is formed from a single strip of shade material which is folded longitudinally in half, and the edges thereof are glued together to form a fin. The side of one cell is affixed to the side of the next adjacent cell adjacent the centerline of the sides. The ratio of cell height to cell width may be varied, without affecting the overall aesthetic presentation of the shade, by varying the size of the fin.

34 Claims, 5 Drawing Sheets

U.S. PATENT DOCUMENTS

| | | | |
|---|---|---|---|
| 4,762,161 | 8/1988 | Anderson | 160/178.2 |
| 4,777,673 | 10/1988 | Patteson et al. . | |
| 4,793,396 | 12/1988 | Anderson et al. | 160/84.1 |
| 4,795,515 | 1/1989 | Kao et al. | 156/197 |
| 4,813,468 | 3/1989 | Fraser | 160/84.1 |
| 4,846,243 | 7/1989 | Schneider | 160/84.1 |
| 4,849,039 | 7/1989 | Colson et al. | 156/197 |
| 4,861,404 | 8/1989 | Neff | 156/204 |
| 4,862,941 | 9/1989 | Colson | 160/84.1 |
| 4,871,006 | 10/1989 | Kao et al. | 160/84.1 |
| 4,884,612 | 12/1989 | Schnebly et al. | 160/84.1 |
| 4,885,190 | 12/1989 | Schnebly | 427/207.1 |
| 4,901,419 | 2/1990 | Voss | 29/412 |
| 4,913,210 | 4/1990 | Colson et al. | 160/84.1 |
| 4,915,763 | 4/1990 | Swiszcz | 156/209 |
| 4,928,369 | 5/1990 | Schnebly et al. | 29/24.5 |
| 4,934,434 | 6/1990 | Schnebly et al. | 160/84.1 |
| 4,934,436 | 6/1990 | Schnebly | 160/84.1 |
| 4,943,454 | 7/1990 | Neff | 428/12 |
| 4,945,969 | 8/1990 | Schnebly et al. | 160/84.1 |
| 4,974,656 | 12/1990 | Judkins | 160/84.1 |
| 5,002,112 | 3/1991 | Schnebly et al. | 160/84.1 |
| 5,002,628 | 3/1991 | Schnebly | 156/379 |
| 5,015,317 | 5/1991 | Corey et al. | 160/84.01 X |
| 5,043,038 | 8/1991 | Colson | 156/193 |
| 5,043,039 | 8/1991 | Swiszcz | 156/197 |
| 5,049,424 | 9/1991 | Carden et al. | 428/35.8 |
| 5,078,195 | 1/1992 | Schon | 160/84.1 |
| 5,097,884 | 3/1992 | Sevcik et al. | 160/84.1 |
| 5,106,444 | 4/1992 | Corey et al. | 156/197 |
| 5,129,440 | 7/1992 | Colson | 160/84.1 |
| 5,135,461 | 8/1992 | Corey et al. | 493/7 |
| 5,141,041 | 8/1992 | Katz et al. | 160/84.1 |
| 5,156,196 | 10/1992 | Corey et al. | 160/178.2 |
| 5,160,563 | 11/1992 | Kutchmarek et al. | 156/204 |
| 5,193,601 | 3/1993 | Corey et al. | 160/84.1 |
| 5,207,257 | 5/1993 | Rupel et al. | 160/84.1 |
| 5,341,864 | 8/1994 | Rupel et al. | 160/84.1 B |

CELLULAR SHADE

RELATED APPLICATION

This application is a continuation-in-part of application entitled "Cellular Shade Material", Ser. No. 08/208,981 filed Mar. 10, 1994, abandoned.

BACKGROUND OF THE INVENTION

The present invention is directed to closures for apertures in which the closure has a first position in which the closure may be fully extended to cover the aperture, a second position in which the closure may be fully retracted to uncover the aperture to the fullest extent, and intermediate positions between the first position and second position in which the closure partially covers the aperture. More particularly, the invention is directed to retractable closures for windows, where the closure may be positioned to block off all or a portion of the window. The invention is still further directed to such retractable closures, wherein a series of individual cells, each of which enclose a discrete longitudinal space, are disposed across the span of the closure to form a decorative window shade which may be actuated between open, intermediate and closed positions.

For many decades, retractable window coverings have been employed to close off the view through a window. A "venetian" blind is one such common window covering. During the energy crisis of the 1970's, window coverings were introduced wherein the slats of the "venetian" blind were replaced by individual air trapping pleats, or cells. These cells are formed by configuring the fabric which comprises the body of the window covering into groups of longitudinal extending tubular pleats, which extend either the width, or height, of the window to be covered. In a top retracting shade, the cells constitute a series of horizontal tubes stacked and interconnected one atop the other. In a side retracting shade, the cells constitute a series of vertical tubes interconnected along their sides. In a top pulling shade, the lowest tube in the series is received in lower rail assembly, and the lower rail assembly is interconnected, by the extending cells and at least two pullcords, to an upper rail assembly at the top of the shade. The upper rail and lower rail assemblies typically include an outer channel into which an inner rail is received. The last cell in the shade is pinched between the channel and inner rail, to secure the cell to the rail assembly. A slat may extend through the cell within the rail assembly and double-sided tape may be used between the cell and inner rail to further secure the cell in the rail assembly. Pullcords are attached to the lower rail assembly and pass upwardly through the cells and into the upper rail assembly, with a portion of the cords extending through the upper rail assembly and hanging down along the side of the shade. The ends of the pullcords are joined, and may be attached to a single lift cord. When the lift cord is pulled, the lower rail assembly attached to the cords actuates upward, causing the individual cells adjacent thereto to collapse into flat sections as the lower rail assembly moves upwardly to open the shade. In the partially open position, those cells adjacent the lower rail assembly are collapsed while those extending downward from the top of the shade remain open. Thus, as the lower rail assembly moves upwardly, the cell next adjacent to the lower rail assembly and stack of collapsed cells thereon collapses. When the shade is fully retracted, all of the cells are collapsed to provide a structure having a lower rail assembly, a stack of collapsed cells thereon, and an upper rail assembly disposed at the top of the opening. To extend the shade, the lift cord is manipulated to allow the lower rail assembly to fall or actuate away from the upper rail assembly, which carries the stack of collapsed cells downward thereon. The uppermost cell will first open as the lower rail assembly moves from the upper rail. As the lower rail assembly continues to fall, consecutive cells open from the top of the stack of folded cells. If the movement of the rail assembly is stop to partially obstruct the view through the window, the shade will have a series of open cells extending from the upper rail assembly to a stack of collapsed cells stacked on the lower rail assembly.

It is contemplated that this structure may be reversed, and the cords rerouted, such that in the retracted position the stack of collapsed cells, and the upper rail assembly thereon, are located at the base of the window, and when the free end of the cord is pulled, the upper rail assembly extends the cells attached thereto into an open position as it moves upwardly. This configuration is particularly useful on first floor windows, where the lower pan of the window may be blocked for privacy, and the upper half of the window exposed to allow sunlight to enter through the window or opening. Additionally, side opening shades may be constructed, and in such shades the upper and lower rail assemblies and cell assembly are turned to a vertical position, and the window is exposed, or blocked, by actuating the "lower" rail assembly transversely across the window or opening.

The individual cells of the shade are typically manufactured by interconnecting discrete folded strips of shade fabric to form air-enclosing cells. Each folded strip may substantially form the boundary of an individual cell, or opposite sides of folded strips may be staggered to form different portions of adjacent cells. For example, U.S. Pat. No. 4,450,027, Colson, FIG. 14, discloses a cell structure in which the majority of the cell is defined by one folded strip of fabric. A small gap appears between the edges 44, 43, of the folded fabric strip, and this gap is bridged by the fabric of the next adjacent cell. As for staggered fabric-to-cell construction, U.S. Pat. No. 4,631,217, Anderson, discloses a structure in which each fabric strip comprises approximately one-half of each of two adjacent cells.

SUMMARY OF THE INVENTION

A pleated shade material is provided for use in a shade to adjustably cover all or part of a window opening. The shade material includes a plurality of pleated cells having opposed cell walls. Each cell is assembled from one length of shade material which is folded longitudinally to form upper and lower cell walls, and the walls are interconnected adjacent their free edges to form the cell. To form the shade one cell wall of one cell is interconnected to the opposite cell wall of the next adjacent cell. The size and aesthetic presentation of the cell may be varied by varying the distance from the free edges of the cell walls at which the cell walls of each individual cell are connected, and by varying the width and placement of the interconnection zone.

BRIEF DESCRIPTION OF THE DRAWINGS

These, and other advantages and embodiments of the invention will become apparent from reading the accompanying description, with reference to the accompanying drawings, wherein.

BRIEF DESCRIPTION OF THE PREFERRED EMBODIMENT

Figure 1:
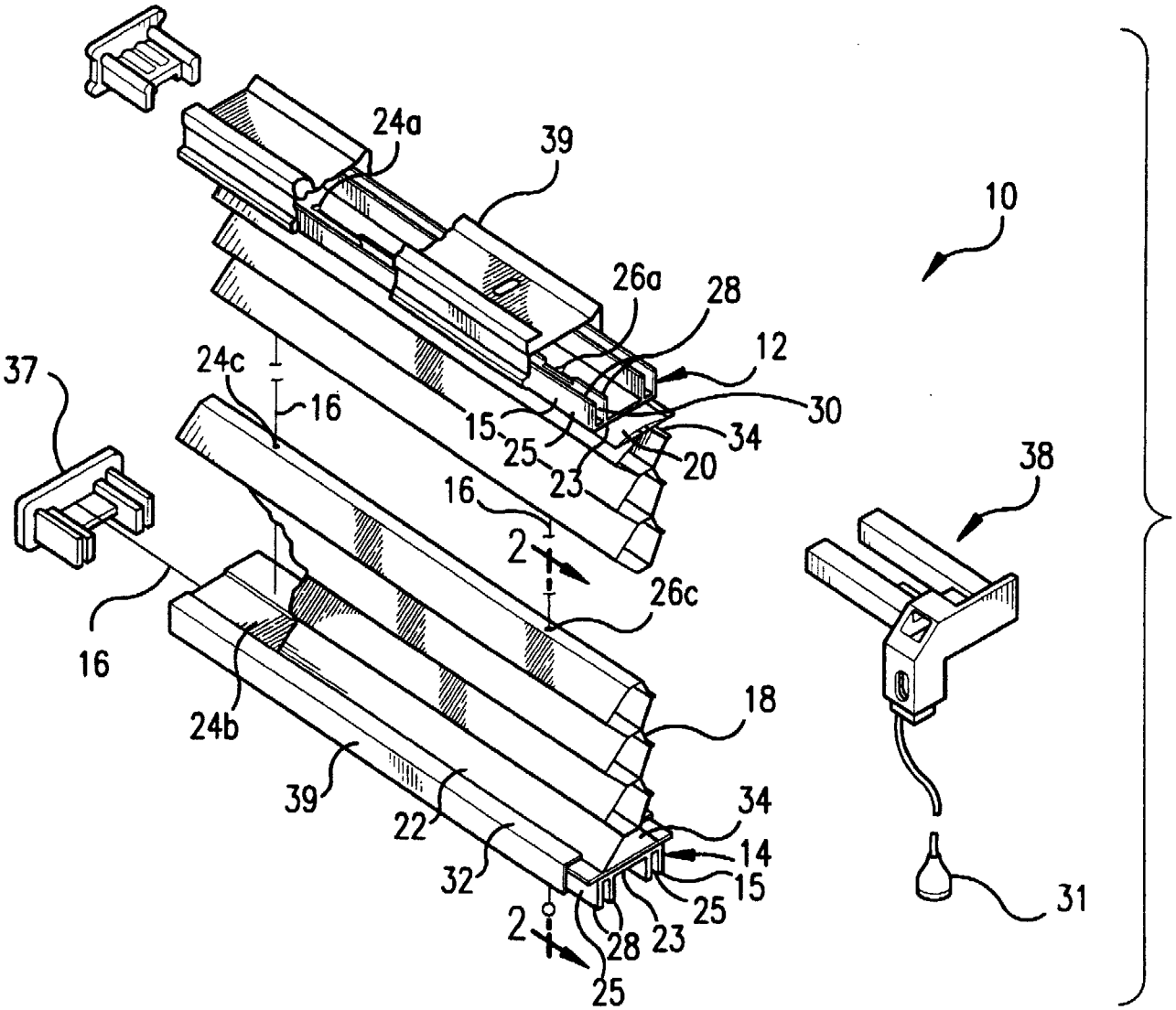
FIG. 1 is an exploded view of the pleated shade material of the present invention assembled into a shade assembly.

Referring to FIG. 1, a pleated shade assembly 10 for use with the shade material of the present invention includes an upper rail assembly 12, a lower rail assembly 14, cords 16 and a plurality of interconnected pleat cells 18. The uppermost cell 20 of the plurality of cells 18 is connected to the upper rail assembly 12, and the lowermost cell 22 of cells 18 is connected to lower rail assembly 14, and thus cells 18 interconnect upper rail assembly 12 and lower rail assembly 14.

Upper rail assembly 12 and lower rail assembly 14 each include a rail portion 15, which includes a generally flat cell attachment portion 23 having opposed extending finger portions 25 extending therefrom substantially perpendicular thereto. Finger portions 25 include two parallel extending walls 28, forming space 30 therebetween. Uppermost cell 20 of the plurality of cells 18 is attached to cell attachment portion 23 of rail portion 15 of upper rail assembly 12, and lowermost cell 22 of the plurality of cells 18 is attached to cell attachment portion 23 of rail portion 15 of lower rail assembly 14.

Upper and lower rail assemblies 12, 14 further include a locking channel 39, which is configured to receive inner rails 15. Each locking channel 39 includes an opposed overriding lip portion 32 which is received over cell attachment portion 23 on inner rail 15 (best shown in FIG. 2). To help secure upper cell 20 on upper inner rail 15, and lower cell 22 on lower inner rail 15, a thin total slat 34 is placed through cells 20, 22, and the cells 20, 22 and inner rails 15 are slipped into the end of upper and lower rail assemblies 12, 14. Overriding lip portions 32 of channel 39 press the outer surface of each of cells 20, 22 and slat 34 therein against inner rail 15. Because slat 34 extends under lip portions 32, the flexible fabric which forms the walls of uppermost and lowermost cells 20, 22 is prevented from pulling out from under lip portions 32 by the edges of slat 34. Double-sided tape or other fastening means may be provided between inner rail 15 and the fabric of respective cell 20, 22 to limit movement of the cell with respect to inner rail 15.

To actuate lower rail assembly 14 upwardly to open shade assembly 10, holes 24*a*, 26*a* are provided in upper inner rail 15, holes 24*b*, 26*b* are provided in lower inner rail 15 (26*b* shown in FIG. 2), and holes 24*c*, 26*c* are provided through cells 18. Holes 24, *a,b,c* are aligned, as are holes 26*a*, b, c. Cords 16 are secured through each series of holes 24*a, b, c* and 26*a, b, c*, and are connected to one of two end caps 37 (only one shown) provided in the end of lower inner rail 15 of lower rail assembly 14. The cords 16 are passed through upper inner rail 15, and are received through a ratchet 38 disposed into one end of upper rail assembly 12 and partially received in the spaces 30 in the end of inner rail 15. Ratchet 38 selectively secures cords 16 therein to hold shade assembly 10 open when desired.

Figure 2:
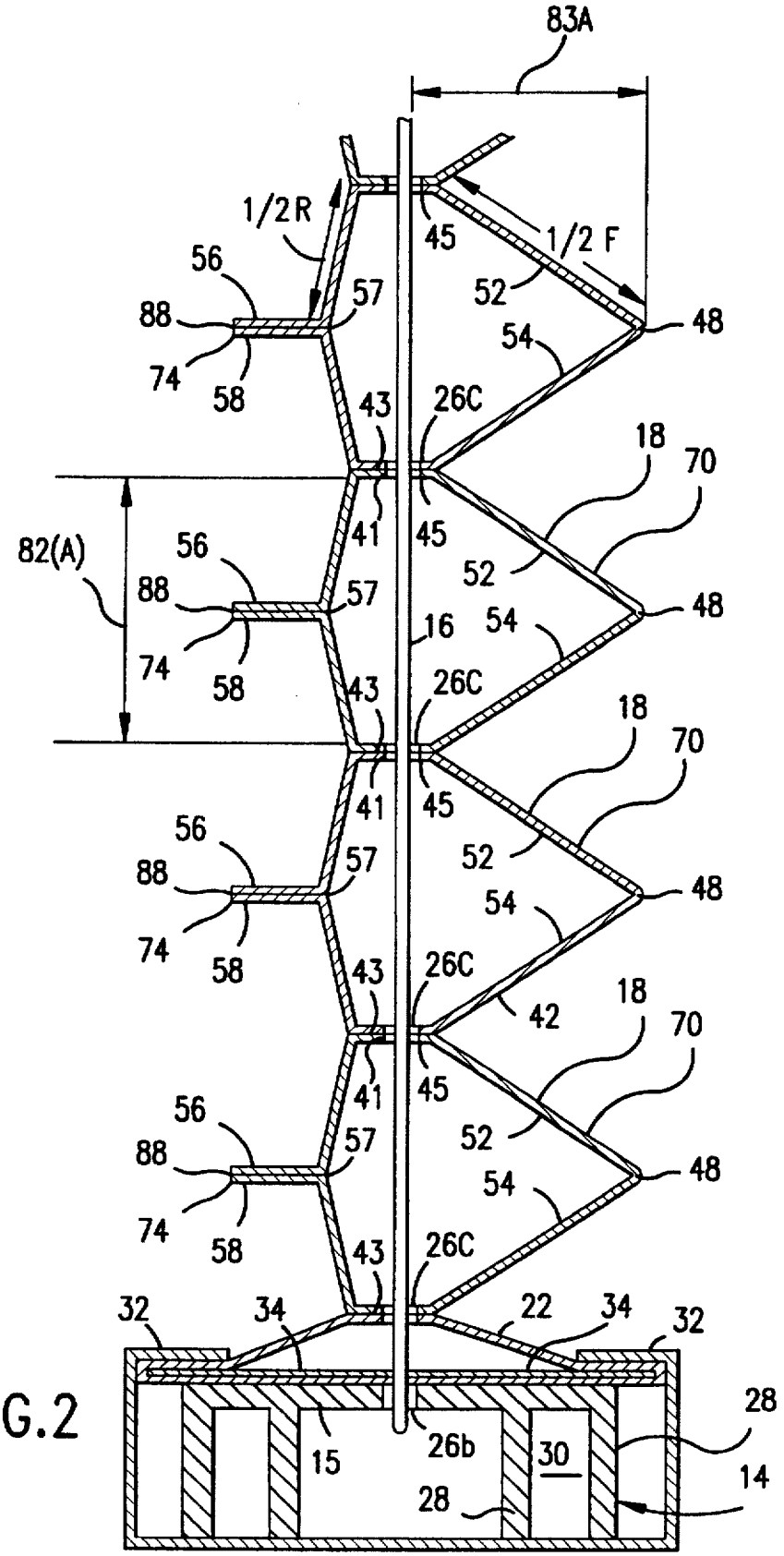
FIG. 2 is a sectional view of the shade assembly of FIG. 1 at section 2—2.
Figure 3:
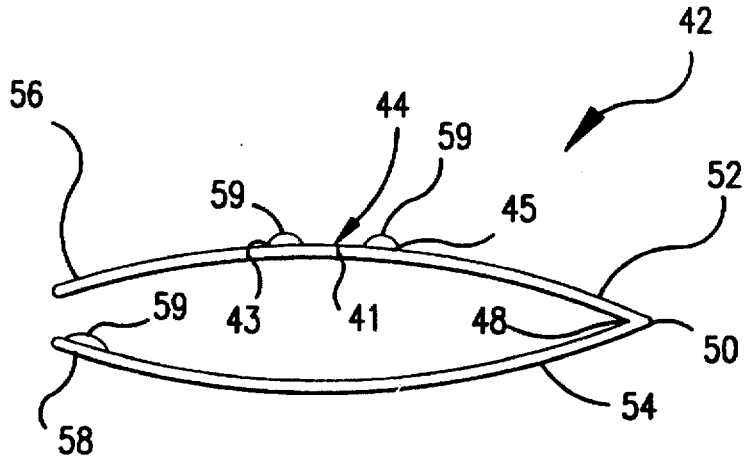
FIG. 3 is an end view of the shade fabric of the present invention prior to assembly into a cell.

Referring now to FIGS. 2 through 5, the structure of the individual cells is shown. As shown in FIG. 3, each of cells 18 is comprised of a length of shade material 42 having opposed edges 56, 58, and a longitudinal center line 50 disposed therebetween. To create the configuration shown in FIG. 3, a length of shade material 42 is folded longitudinally about longitudinal center line 50. This folding creates a crease 48 formed along the approximate longitudinal center line 50 of the length of shade material, creating upper and lower cell walls 52, 54 extending between the opposed edges 56, 58 and the crease 48 of shade material 42. The span of shade material 42 between crease 48 and edge 56 forms the upper cell wall 52, and the span between crease 48 and edge 58 forms the lower cell wall 54. The center of mass of the shade material lies on a centerline 41 that is midway between crease 48 and edges 56, 58.

Figure 4:
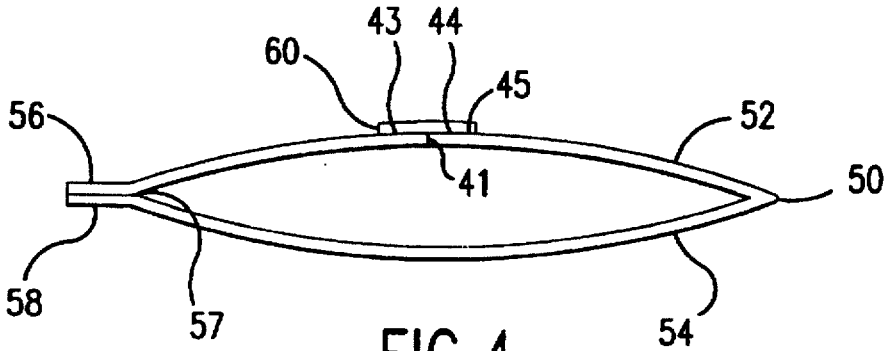
FIG. 4 is an end view of a single cell prior to assembly into a shade.
Figure 5:
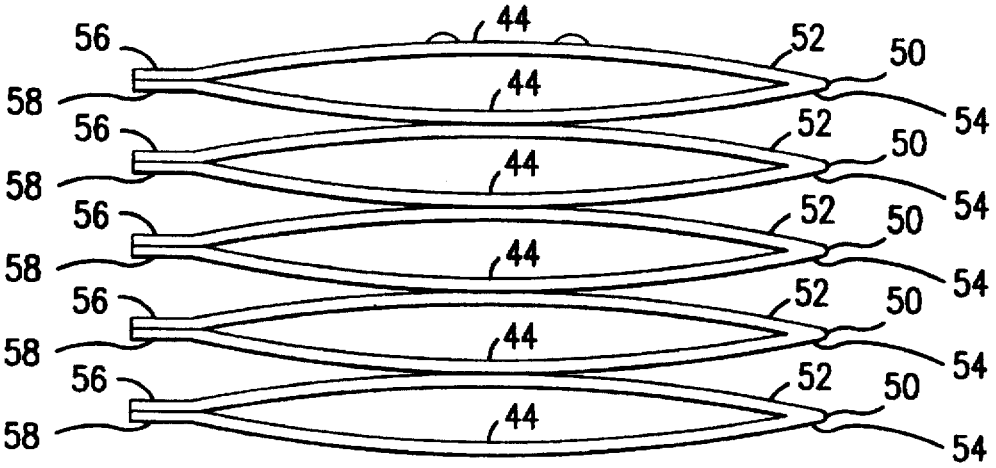
FIG. 5 is an end view of a plurality of interconnected cells.

To create the individual cells 18 of FIGS. 3 or 4, a continuous length of shade material, preferably several hundred feet long, is folded to form crease 48, and the folded or creased length of shade material receives the glue beads 59, tape 60 or other adhesive means thereon for interconnecting the edges 56, 58 of each cell 18 and for connecting adjacent cells 18 at zones 43, 45. Glue is presently preferred to adhesive attachment. Alternatively, the adhesive can be omitted and sonic welding can be used to bond the free edges 56, 58. The continuous length of creased fabric is preferably rolled onto a core, and then later unrolled and cut into lengths corresponding to the proper shade span. Once the lengths of folded shade material are cut to the length for specific enclosure span, they are stacked together with the edges 56, 58 vertically aligned, and the individual cells 18 of edges 56, 58, and the upper and lower cell 52, 54 walls of pleats 18, are adjacent.

A fin 74 is formed from the attached portion of edges 56, 58. The innermost connection point between edges 56, 58 defines inward termination 57. The portions of edges 56, 58 extending beyond inward termination 57 form fin 74.

To create a shade, edges 56, 58 are interconnected as shown in FIG. 4, and a portion of the upper cell wall 52 of one cell 18 is interconnected to the lower cell wall 54 of an adjacent cell 18 along an interconnection zone 44. When the cells are assembled in this manner, interconnection zone 44 has rear and front terminations 43, 45, respectively. Interconnection zone 44 can be formed by placing a glue bead 59 along interconnection termination 43, 45 as shown in FIG. 3. Glue beads 59 extend longitudinally along the length of each upper cell wall 52. Alternatively, an adhesive strip 60 can be placed on upper cell wall spanning the entire width of interconnection zone 44 between terminations 43, 45 as shown in FIG. 4. Other means of connecting the upper cell wall 52 of one cell to the lower cell wall 54 of an adjacent cell will be readily understood, including using a single, wide glue bead in place of adhesive 60. Where glue beads 59 are used to connect adjacent surfaces, the stack of cells 18 are placed under heat and pressure. Where the edges 56, 58 are sonically sealed, the edges 56, 58 are first connected by the sonic sealing, and then the cells 18 are glued together along the zones 43, 45 by heat and/or pressure as required. Sonic welding is not suitable for interconnecting adjacent cells because of the need to prevent the formation of a bond between the upper and lower cell walls.

Shade material 42 preferably comprises Hovolin 7760, a latex bonded nonwoven fabric, manufactured by Hollingsworth/Vose of Floyd, Va. Alternatively, shade material 42 may comprise spun laced polyester, spun-bond polyester, or thermo bond polyester. Glue bead 59 may be a high temperature, hot-melt thermo plastic polyester UV-stabilized material, such as Tivolmelt 195-a, available from Ward Adhesives of Waukesha, Wis., or a non-crystallizing version thereof. It is contemplated that other materials may be used for the shade material 42 and/or glue bead 59 without departing from the scope of the invention.

Referring again to FIG. 2, a plurality of fully extended cells 18 are shown connected to a rail assembly 14. Individual cells 18 include projecting angled faces 70 which meet at crease 48 on the front side of the shade. Each cell has a height 82 and a forward depth 83. The construction shown in FIG. 2 is one embodiment of the present inventions and serves as a reference against which other embodiments are compared in the following discussion.

It will be understood that the overall outward appearance of each cell 18, and of the shade in general, depends on the placement of interconnection zone 44 and the width of fin 74. The width of fin 74 is determined by the distance between inward termination 57 and the edges 56, 58 of the shade material. The available rear span R of cell 18 is defined as two times the distance between rear termination 43 and inward termination 57. The available forward span F is defined as two times the distance between forward termination 45 and crease 48. To the extent that the available rear span R is less than the available forward span F, the rear walls of each cell will reach their full expansion before the front face of each cell is fully expanded, as shown in FIG. 2. Thus the height 82 of each cell will limited by the available rear span R. As shown in FIGS. 2–4, in this embodiment interconnection zone typically encompasses centerline 41.

Figure 6:
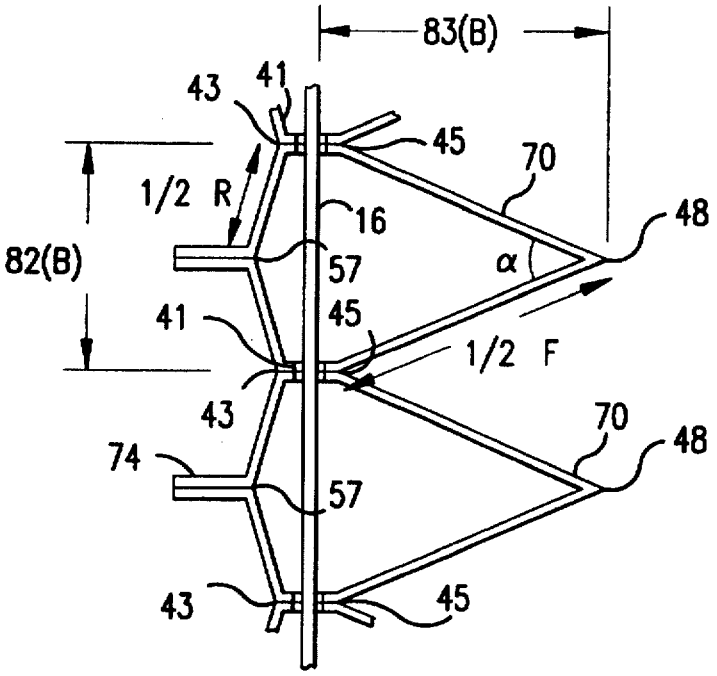
FIG. 6 is an alternative configuration of a plurality of cells of the pleated shade of the present invention.

Referring now to FIG. 6, if the available rear span R is decreased by expanding the width of fin 74 and the position of interconnection zone 44 is not altered, the height 82(B) of each cell will decrease and the angle formed at crease 48 will also decrease resulting in a deeper shade pleat having a depth 83(B).

Figure 7:
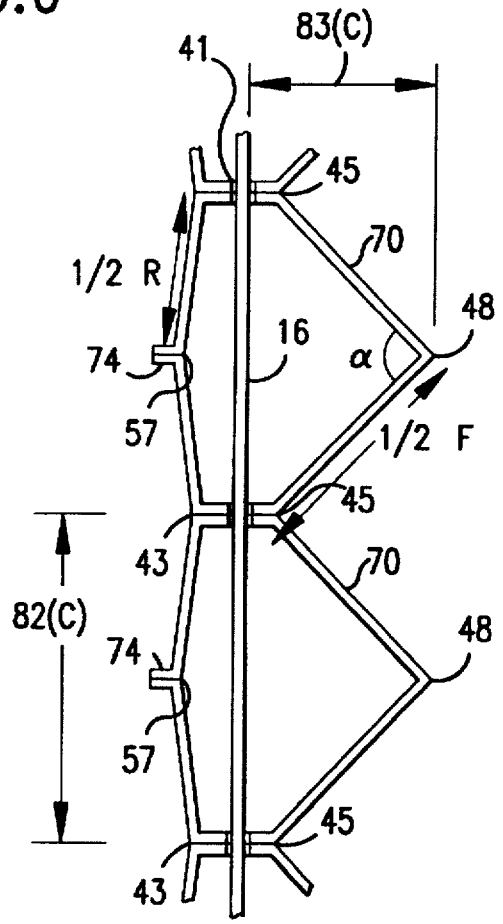
FIG. 7 is a second alternative configuration of a plurality of cells of the pleated shade of the present invention.

Referring now to FIG. 7, if the available rear span R is increased by decreasing the width of fin 74 and the position of interconnection zone 44 is not altered, the height 82 of each cell will increase, resulting in a corresponding increase in the angle formed at crease 48, with the result that cells formed in this manner will be shallower than those shown in FIG. 2. This produces an increased cell height 82(C) and decreased cell depth 83(C).

Figure 8:
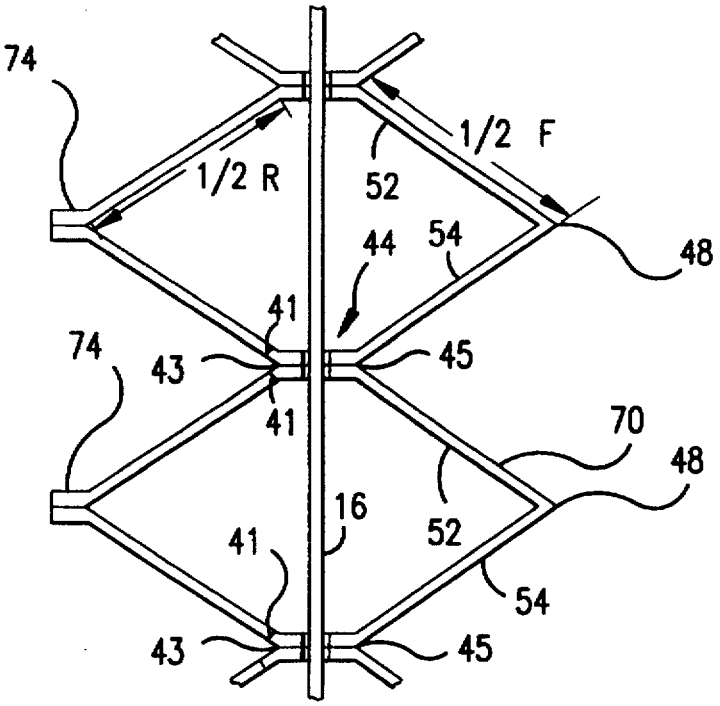
FIG. 8 is a third, preferred configuration of a plurality of cells of the pleated shade of the present invention.

It is presently preferred to have the available rear span R be equal to the available forward span F, as shown in FIG. 8. In this embodiment, interconnection zone 44 is longitudinally centered between crease 48 and inward termination 57, and therefore lies somewhat forward of centerline 41. This is because centerline 41 takes into account the portions of cell walls 52, 54 that form fin 74. The smaller the width of fin 74 is, therefore, the closer interconnection zone 44 will be to the longitudinal centerline 41 of cell walls 52, 54. In this preferred embodiment, neither the available forward span F nor the available rear span R solely limits the height of the cell, as they are equal. Instead, vertical expansion of each cell will depend on the load applied to the cell by the weight of the shade below it, and on the flexability and springiness of the shade material.

Figure 9:
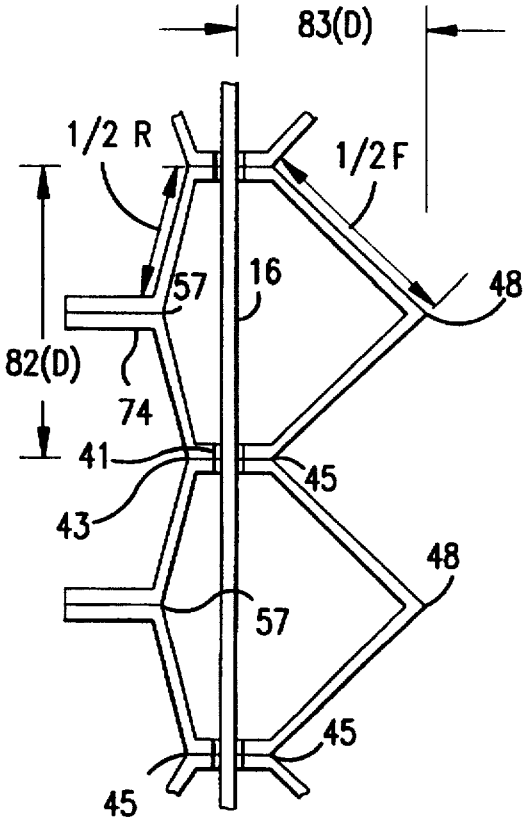
FIG. 9 is a fourth alternative configuration of a plurality of cells of the pleated shade of the present invention.
Figure 10:
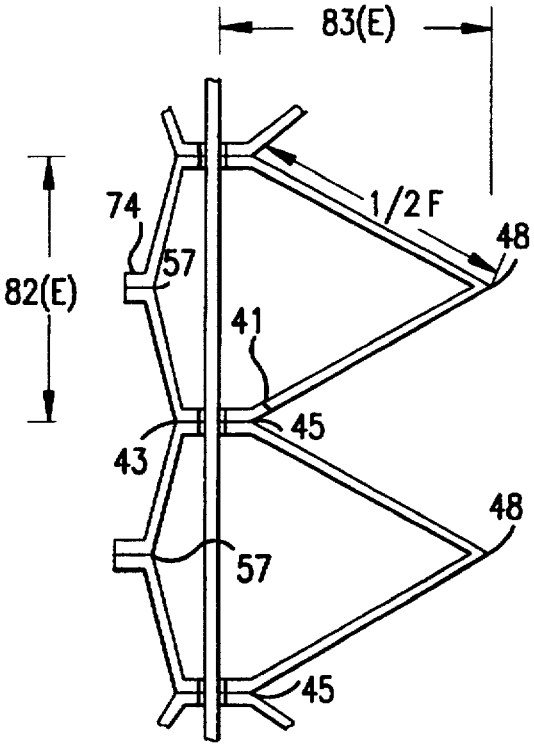
FIG. 10 is a fifth alternative configuration of a plurality of cells of the pleated shade of the present invention.

Other, alternative embodiments of the present invention include those shown in FIGS 9 and 10. In FIG. 9, the width of fin 74 is increased relative to that shown in FIG. 2. Unlike FIG. 6, however, the available rear span R is not decreased from that shown in FIG 2. This is accomplished by moving the position of interconnection zone 44 forward toward crease 48 so that its center lies forward of centerline 41. This produces a cell that has a height 82(D) approximately equal to the height of the cells shown in FIG. 2 but which has a reduced cell depth 83(D).

In FIG. 10, the width of fin 74 is reduced as shown in FIG. 7, but the position of interconnection zone 44 is shifted toward fin 74 relative to the configuration shown in FIG 2. Thus, interconnection zone 44 lies somewhat to the rear of centerline 41. This produces a cell that has a height 82(E) approximately equal to the height of the cells shown in FIG. 2 but which has a increased cell depth 83(E). It will be understood from the foregoing that multiple variations on the overall cell appearance including cell height 82 and cell depth 84 can be achieved by manipulating the width of fin 74 and/or the width and placement of interconnection zone 44.

Although the present invention has been described in terms of a horizontal shade with hidden pullcords, the configuration of the pull cords, and parts thereof, may be varied without deviating from the scope of the invention. Likewise, the cell 18 of the present invention is well suited to side pull, i.e., vertical shades, and bottom retracting shades.

We claim:

1. A cellular pleated shade member having a plurality of cells, at least one of the cells comprising:

a strip of shade material folded lengthwise to form an upper cell wall and a lower cell wall extending from a fold, each upper and lower cell wall having a free edge and a folded edge merging with the adjacent wall of the strip at said fold;

said upper cell wall and lower cell wall of said strip connected adjacent their respective free edges and forming a fin at said connection;

wherein said upper cell wall is attached to a lower cell wall of a first adjacent cell at an upper interconnection zone, said upper interconnection zone being located on said upper cell wall between said fin and said fold; and wherein said lower cell wall is attached to an upper cell wall of a second adjacent cell at a lower interconnection zone, said lower interconnection zone being located on said lower cell wall between said fin and said fold.

2. The cellular pleated shade according to claim 1, wherein said upper cell wall includes a centerline midway between said free edges and said fold and said upper cell wall is attached to said first adjacent cell along said centerline.

3. The cellular pleated shade according to claim 1, wherein said upper cell wall includes a centerline midway between said free edges and said fold and said upper cell wall is attached to said first adjacent cell between said centerline and said fold.

4. The cellular pleated shade according to claim 1, wherein said upper cell wall includes a centerline midway between said free edges and said fold and said upper cell wall is attached to said first adjacent cell between said centerline and said fin.

5. The cellular pleated shade of claim 1, wherein said upper interconnection zone has two side terminations, said side terminations being on opposite sides of said longitudinal centerline of said upper cell wall.

6. The cellular pleated shade of claim 1, wherein said free edges of said upper cell wall and lower cell wall are connected by sonic welding.

7. The cellular pleated shade of claim 1, wherein said free edges of said upper cell wall and lower cell wall are connected by an adhesive glue.

8. The cellular pleated shade of claim 5, further comprising:

a pullcord disposed through said plurality of cells and through said upper and lower interconnection zones.

9. The cellular pleated shade of claim 2, wherein said lower cell wall is attached to said second adjacent cell by means a glue bead.

10. The cellular pleated shade of claim 2, wherein said lower cell wall is attached to said second adjacent cell by means of an adhesive strip.

11. A cellular shade, having a plurality of interconnected fabric cells for covering a window, at least one of the cells comprising:

a strip of nonwoven fabric shade material folded at a tip to form an upper cell wall and a lower cell wall, said upper cell wall extending from said tip and having a rear edge and said lower cell wall extending from said tip and having a rear edge;

a fin, wherein said fin is formed by joining a portion of said upper cell wall adjacent said rear edge of said upper cell wall with a portion of said lower cell wall adjacent said rear edge of said lower cell wall;

means for attaching said upper cell wall of said cell to a lower cell wall of a first adjacent cell; and means for attaching said lower cell wall of said cell to an upper cell wall of a second adjacent cell.

12. A cellular shade for covering a window, said shade comprising:

a plurality of interconnected fabric cells, wherein each cell has:

a front side and a rear side;

a crease forming a tip on said front side;

an upper cell wall extending from said crease and having a rear edge, said upper cell wall having a longitudinal centerline equidistant along said upper cell wall from said crease and from said rear edge of said upper cell wall;

a lower cell wall extending from said crease and having a rear edge, said lower cell wall and said upper cell wall being substantially equal in length;

a fin on said rear side, wherein said fin is formed by joining a portion of said upper cell wall adjacent said rear edge of said upper cell wall with a portion of said lower cell wall adjacent said rear edge of said lower cell wall; and material located on at least one of said upper cell wall and said lower cell wall for attaching said each cell of said plurality of cells to an adjacent cell of said plurality of cells;

wherein substantially all cells of said plurality of cells have for each cell an interconnection zone on said upper cell wall, said interconnection zone defined by said material when said material is located on said upper cell wall; and wherein said interconnection zone has an interconnection centerline.

13. The cellular shade of claim 12, wherein the location of said interconnection centerline is forward of said longitudinal centerline.

14. The cellular shade of claim 13, wherein said material is a high temperature, hot-melt thermo plastic polyester UV-stabilized adhesive.

15. The cellular shade of claim 13, wherein said material is an adhesive strip.

16. The cellular shade of claim 13, wherein the fabric of said interconnected fabric cells is a nonwoven fabric.

17. The cellular shade of claim 13, wherein the fabric of said interconnected fabric cells is polyester.

18. A cellular shade for covering a window, said shade comprising:

a plurality of interconnected fabric cells, wherein substantially all cells within said plurality of cells have for each cell:

a from side and a rear side;

a crease forming a tip on said front side;

an upper cell wall extending from said tip and having a rear edge, said upper cell wall having an upper surface and an interior surface and having a longitudinal centerline equidistant along said upper cell wall from said tip and from said rear edge of said upper cell wall;

a lower cell wall extending from said tip and having a rear edge, said lower cell wall having a lower surface and an interior surface, said lower cell wall and said upper cell wall being substantially equal in length;

a fin on said rear side, wherein said fin is formed by joining a portion of said upper cell wall adjacent said rear edge of said upper cell wall with a portion of said lower cell wall adjacent said rear edge of said lower cell wall;

an adhesive on said upper cell wall, said adhesive for connecting said each cell to an adjacent cell of said plurality of cells; and an interconnection zone defined by said adhesive, wherein said interconnection zone has an interconnection centerline and said interconnection centerline is forward of said longitudinal centerline;

wherein when said cellular shade is extended, a portion of the interior surface of said upper cell wall and a portion of the interior surface of said lower cell wall define a six-sided polygon, said six-sided polygon having an upper rear side, an upper middle side, an upper front side, a lower front side, a lower middle side, and a lower rear side; and wherein said fin, said upper middle side and said lower middle side are substantially in parallel arrangement.

19. The cellular shade of claim 18, wherein an interior angle defined by said upper front side and said lower front side is approximately equal to an interior angle defined by said upper rear side and said lower rear side.

20. The cellular shade of claim 19, wherein said adhesive includes a plurality of glue beads.

21. The cellular shade of claim 20, wherein said glue beads extend longitudinally along said upper surface of said upper cell wall of said cell.

22. The cellular shade of claim 21, wherein said portion of said upper cell wall adjacent said rear edge of said upper cell wall is joined with said portion of said lower cell wall adjacent said rear edge of said lower cell wall by glue.

23. The cellular shade of claim 21, wherein said portion of said upper cell wall adjacent said rear edge of said upper cell wall is joined with said portion of said lower cell wall adjacent said rear edge of said lower cell wall by an adhesive strip.

24. The cellular shade of claim 21, wherein said portion of said upper cell wall adjacent said rear edge of said upper cell wall is joined with said portion of said lower cell wall adjacent said rear edge of said lower cell wall by sonic welding.

25. A cellular shade for covering a window, said shade comprising:

a plurality of interconnected fabric cells, wherein each cell within said plurality of cells is comprised of a nonwoven fabric and has:

a front side and a rear side;

a crease forming a tip on said front side;

an upper cell wall extending from said tip and having a rear edge, said upper cell wall having an upper surface and an interior surface and having a longitudinal centerline equidistant along said upper cell wall from said tip and from said rear edge of said upper cell wall;

a lower cell wall extending from said tip and having a rear edge, said lower cell wall having a lower surface and an interior surface, said lower cell wall and said upper cell wall being substantially equal in length; and a fin on said rear side, wherein said fin is formed by joining a first portion of said interior surface of said upper cell wall adjacent said rear edge of said upper cell wall with a first portion of said interior surface of said lower cell wall adjacent said rear edge of said lower cell wall;

a high temperature adhesive on substantially all cells of said plurality of cells, said high temperature adhesive for connecting each cell of said substantially all cells to an adjacent cell of said plurality of cells;

an upper rail assembly, said upper rail assembly attached to an uppermost cell of said plurality of cells;

a lower rail assembly, said lower rail assembly attached to a lowermost cell of said plurality of cells; and a pullcord, said pullcord for raising and lowering one of said upper and lower rail assembly in relation to the other of said upper and lower rail assembly.

26. The cellular shade of claim 25, wherein said high temperature adhesive extends longitudinally along said upper surface of said upper cell wall of said cell.

27. The cellular shade of claim 26, wherein said first portion of said interior surface of said upper cell wall adjacent said rear edge of said upper cell wall is joined with said first portion of said interior surface of said lower cell wall adjacent said rear edge of said lower cell wall by a high temperature adhesive.

28. The cellular shade of claim 27, wherein when said cellular shade is extended, a second portion of said interior surface of said upper cell wall and a second portion of said interior surface of said lower cell wall define a six-sided polygon, said six-sided polygon having an upper rear side, an upper middle side, an upper front side, a lower front side, a lower middle side, and a lower rear side.

29. The cellular shade of claim 28, wherein said fin, said upper middle side and said lower middle side are substantially in parallel arrangement.

30. The cellular shade of claim 28, wherein an interior angle defined by said upper front side and said lower front side is less than an interior angle defined by said upper rear side and said lower rear side.

31. The cellular shade of claim 28, wherein an interior angle defined by said upper front side and said lower front side is approximately equal to an interior angle defined by said upper rear side and said lower rear side.

32. The cellular shade of claim 29, wherein said upper middle side is approximately equal in length to said lower middle side.

33. The cellular shade of claim 32, wherein said high temperature adhesive on substantially all cells of said plurality of cells is on said upper surface of said upper cell wall of each cell of said substantially all cells and defines an interconnection zone for each cell of said substantially all cells, said interconnection zone having an interconnection centerline, and wherein said interconnection centerline is located forward of said longitudinal centerline on said upper surface.

34. A cellular shade for covering a window, said shade comprising:

a plurality of interconnected nonwoven fabric cells, wherein substantially all cells within said plurality of cells have for each cell:

a front side and a rear side;

a crease forming a tip on said front side;

an upper cell wall extending from said tip and having a rear edge, said upper cell wall having an upper surface and an interior surface and having a longitudinal centerline equidistant along said upper cell wall from said tip and from said rear edge of said upper cell wall;

a lower cell wall extending from said tip and having a rear edge, said lower cell wall having a lower surface and an interior surface;

a fin on said rear side, wherein said fin is formed by joining a first portion of said interior surface of said upper cell wall adjacent said rear edge of said upper cell wall with a first portion of said interior surface of said lower cell wall adjacent said rear edge of said lower cell wall; and an interconnection zone on said upper surface, said interconnection zone having an interconnection centerline;

an adhesive on substantially all cells of said plurality of cells, said adhesive for connecting each cell of said substantially all cells to an adjacent cell of said plurality of cells, wherein said adhesive includes a first high temperature glue bead on said upper surface of said upper cell wall and a second high temperature glue bead on said upper surface of said upper cell wall, said first and said second high temperature glue beads being on opposite sides of said longitudinal center line of said upper cell wall, said first and said second high temperature glue beads extending longitudinally along said upper surface of said upper cell wall;

an upper rail assembly, said upper rail assembly attached to an uppermost cell of said plurality of cells;

a lower rail assembly, said lower rail assembly attached to a lowermost cell of said plurality of cells;

a pullcord, said pullcord for raising and lowering said one of said upper and lower rail assembly in relation to the other of said upper and lower rail assembly;

wherein when said cellular shade is extended:

a second portion of said interior surface of said upper cell wall and a second portion of said interior surface of said lower cell wall define a six-sided polygon, said six-sided polygon having an upper rear side, an upper middle side, an upper front side, a lower front side, a lower middle side, and a lower rear side;

the length of said upper middle side and said lower middle side are of approximately equal lengths, the length of said upper middle side being less than the length of either of said upper rear side and said upper front side, and the length of said lower middle side being less than the length of either of said lower rear side and said lower front side; and said fin, said upper middle side and said lower middle side are in substantially parallel arrangement; and wherein said interconnection centerline is forward of said longitudinal centerline on said upper surface.

* * * * *

Adverse Decision In Interference

Patent No. 5,701,940, James A. Ford, Don L. Bertva, James M. Kennedy, Ronald L. Presdorf, CELLULAR SHADE, Interference No. 104,328, final judgment adverse to the patentees rendered September 30, 2004, as to claims 1-34.

*(Official Gazette February 22, 2005)*